US009375600B2

(12) United States Patent
Liu et al.

(10) Patent No.: US 9,375,600 B2
(45) Date of Patent: Jun. 28, 2016

(54) FIGURE TRIMMER

(71) Applicant: Dyaco International Inc., Taipei (TW)

(72) Inventors: Shih-Wei Liu, Tapiei (TW); Hsuan-Fu Huang, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 293 days.

(21) Appl. No.: 14/292,419

(22) Filed: May 30, 2014

(65) Prior Publication Data

US 2015/0238798 A1 Aug. 27, 2015

(30) Foreign Application Priority Data

Feb. 26, 2014 (TW) ..... 103106399 A

(51) Int. Cl.

| | |
|---|---|
| ***A63B 21/00*** | (2006.01) |
| ***A63B 21/045*** | (2006.01) |
| ***A63B 22/16*** | (2006.01) |
| ***A63B 22/14*** | (2006.01) |
| ***A63B 23/035*** | (2006.01) |
| *A63B 21/008* | (2006.01) |
| *A63B 21/02* | (2006.01) |
| *A63B 21/05* | (2006.01) |

(52) U.S. Cl.

CPC ..... *A63B 21/045* (2013.01); *A63B 21/028* (2013.01); *A63B 21/4034* (2015.10); *A63B 21/4047* (2015.10); *A63B 21/4049* (2015.10); *A63B 22/14* (2013.01); *A63B 22/16* (2013.01); *A63B 23/03525* (2013.01); *A63B 23/03541* (2013.01); *A63B 21/008* (2013.01); *A63B 21/0085* (2013.01); *A63B 21/023* (2013.01); *A63B 21/05* (2013.01)

(58) Field of Classification Search

CPC ..... A63B 21/00
USPC ..... 482/51, 52, 126, 147
See application file for complete search history.

(56) References Cited

U.S. PATENT DOCUMENTS 7,137,928 B1 11/2006 Chen

FOREIGN PATENT DOCUMENTS

| | | |
|---|---|---|
| CN | 2598589 | 1/2004 |
| CN | 203736786 | 7/2004 |
| CN | 202289322 | 7/2012 |

*Primary Examiner* — Jerome W Donnelly
(74) *Attorney, Agent, or Firm* — Huffman Law Group, PC

(57) ABSTRACT

A figure trimmer comprises a chassis, a pedal set, a rotating assembly, at least a first elastic component, and at least a second elastic component. The pedal set is arranged on the chassis and is able to restrictedly rotate in horizontal and vertical direction. The rotating assembly couples to the pedal set and the chassis, so as to drive the pedal set rotating in the horizontal direction. When the pedal set rotates in the horizontal direction, the first elastic component exerts an opposite reaction force to the pedal set. When the pedal set rotates in the vertical direction, the second elastic component exerts an opposite reaction force to the pedal set.

10 Claims, 7 Drawing Sheets

FIGURE TRIMMER

CROSS-REFERENCE TO RELATED APPLICATIONS

The entire contents of Taiwan Patent Application No. 103106399, filed on Feb. 26, 2014, from which this application claims priority, are incorporated herein by reference.

BACKGROUND OF THE INVENTION

1. Field of the Invention

The present invention relates to training machines, and more particularly relates to a figure trimmer.

2. Description of Related Art

Conventional figure trimmers include a disc on which a user stands to twist his or her body by the force of legs and waist.

FIG. 1 shows a conventional figure trimmer provided by a Taiwan patent M33009977. As shown in FIG. 1, the figure trimmer includes a base 10 and two discs 12/14.

The conventional figure trimmer has a disadvantage that only a few muscles of the user are used and hence a need is therefore arisen to improve it.

SUMMARY OF THE INVENTION

In one general aspect, the present invention relates to figure trimmers with improved training efficiency.

In an embodiment of the present invention, a figure trimmer is provided with a chassis, a pedal set, a rotating assembly, at least a first elastic component, and at least a second elastic component. The pedal set is arranged on the chassis and is provided for standing by a user. The pedal set is capable of making a reciprocated deflection in a vertical direction due to a vertical force exerted by the user. The rotating assembly couples to the chassis and the pedal set, and the rotating assembly drives the pedal set to make a reciprocated limited rotation around the rotating assembly in a horizontal direction due to a horizontal force exerted by the user. When the pedal set rotates in the horizontal direction, the first elastic component exerts a first opposite reaction force to the pedal set. When the pedal set deflects in the vertical direction, the second elastic component exerts a second opposite reaction force to the pedal set.

In one embodiment, the pedal set comprises a left pedal and a right pedal, and the number of the at least one second elastic component is two with one arranged between the left pedal and the rotating assembly and another arranged between the right pedal and the rotating assembly.

In one embodiment, the rotating assembly comprises a cylinder and two supporting frames, in which the cylinder is arranged on an axle of the chassis, and the two supporting frames are respectively arranged at a side of the cylinder and respectively coupled to the left pedal and the right pedal.

In one embodiment, the first elastic component and the second elastic component are made of a polymer.

In one embodiment, the first elastic component and/or the second elastic component is a spring member.

In one embodiment, the first elastic component and/or the second elastic component is a hydraulic elastic member.

In one embodiment, the first elastic component and/or the second elastic component is a pneumatic elastic member.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1:
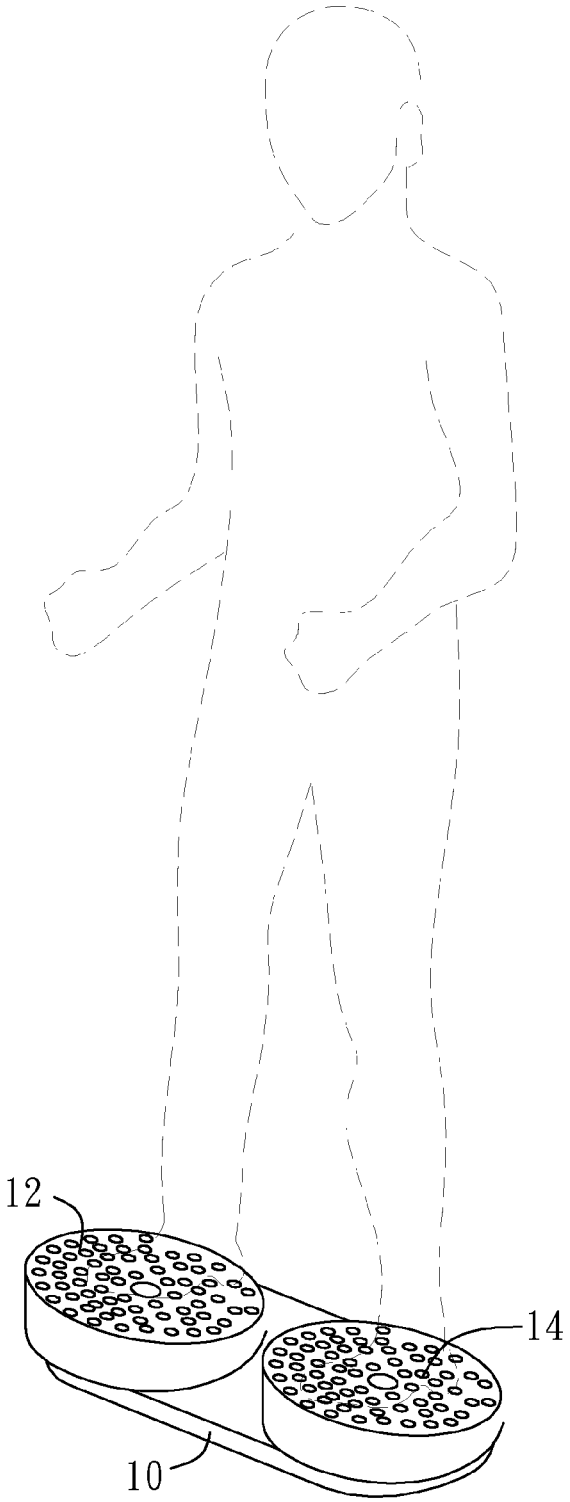
FIG. 1 shows a conventional figure trimmer provided by a Taiwan patent M33009977.
Figure 2:
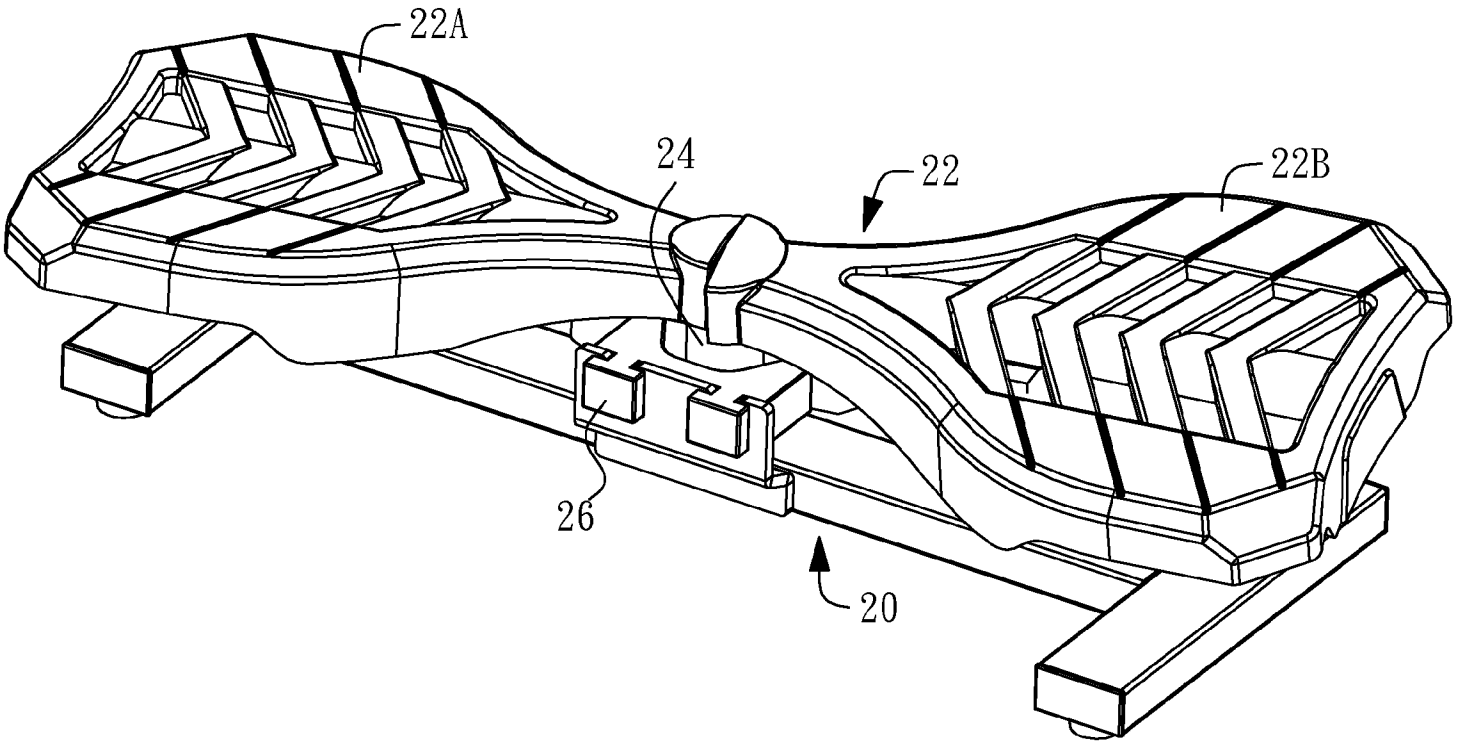
FIGS. 2 and 3 are respectively perspective and exploded view, showing a figure trimmer according to a preferred embodiment of the present invention.
Figure 3:
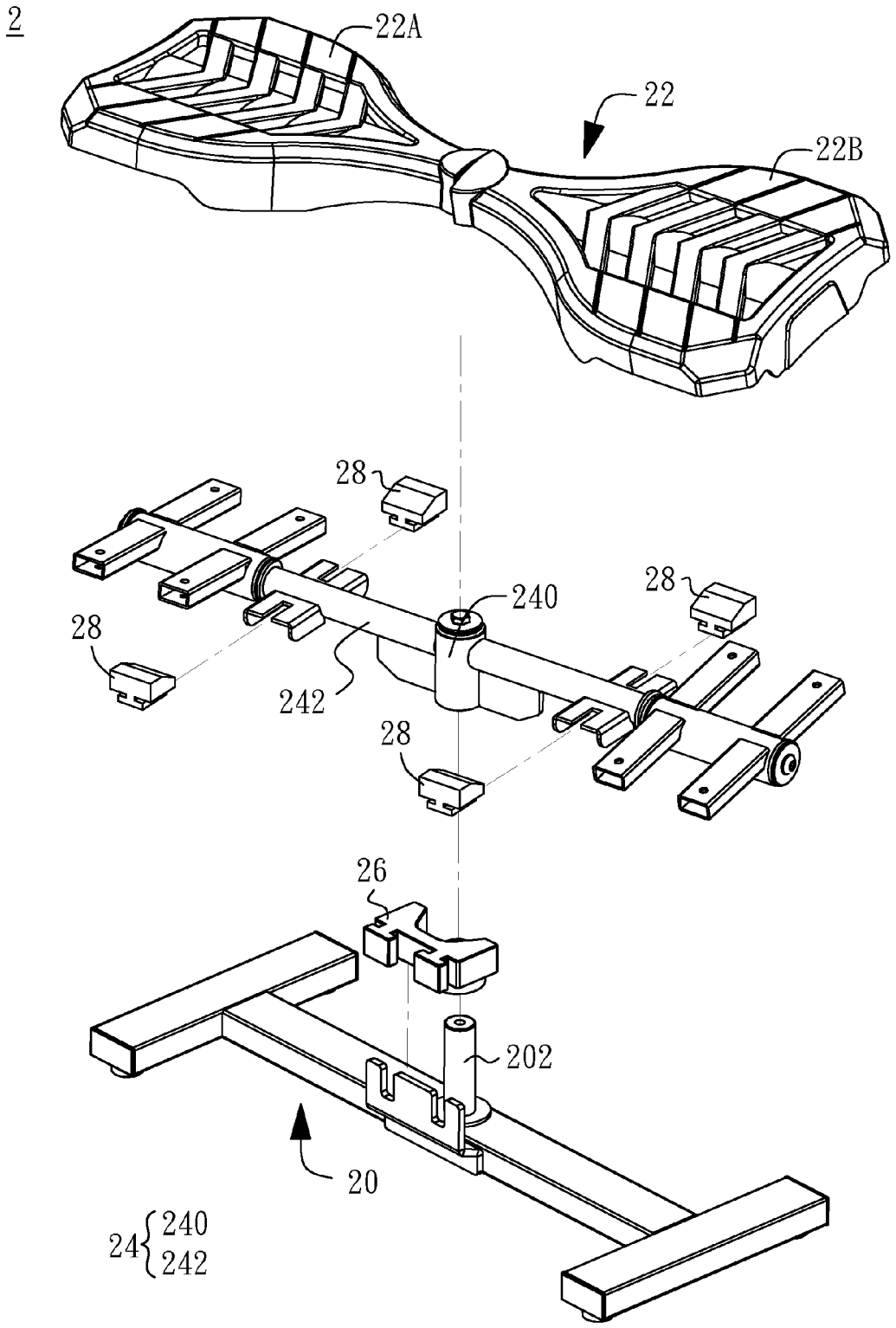

FIGS. 2 and 3 are respectively perspective and exploded view, showing a figure trimmer 2 according to a preferred embodiment of the present invention. As shown in FIG. 2 and FIG. 3, a figure trimmer 2 comprises a chassis 20, a pedal set 22, a rotating assembly 24, at least a first elastic component 26, and at least a second elastic component 28. The pedal set 22 is arranged on the chassis 20. A user steps on the pedal set 22, and may exert a force to cause the pedal set 22 making a reciprocated deflection in a vertical direction. The rotating assembly 24 couples to the chassis 20 and the pedal set 22, and the user may exert a force to cause the pedal set 22 making a reciprocated limited rotation around the rotating assembly 24 in a horizontal direction. When the pedal set 22 rotates in the horizontal direction, the first elastic component 26 exerts an opposite reaction force to the pedal set 22. When the pedal set 22 deflects in the vertical direction, the second elastic component 28 exerts an opposite reaction force to the pedal set 22.

Figure 4:
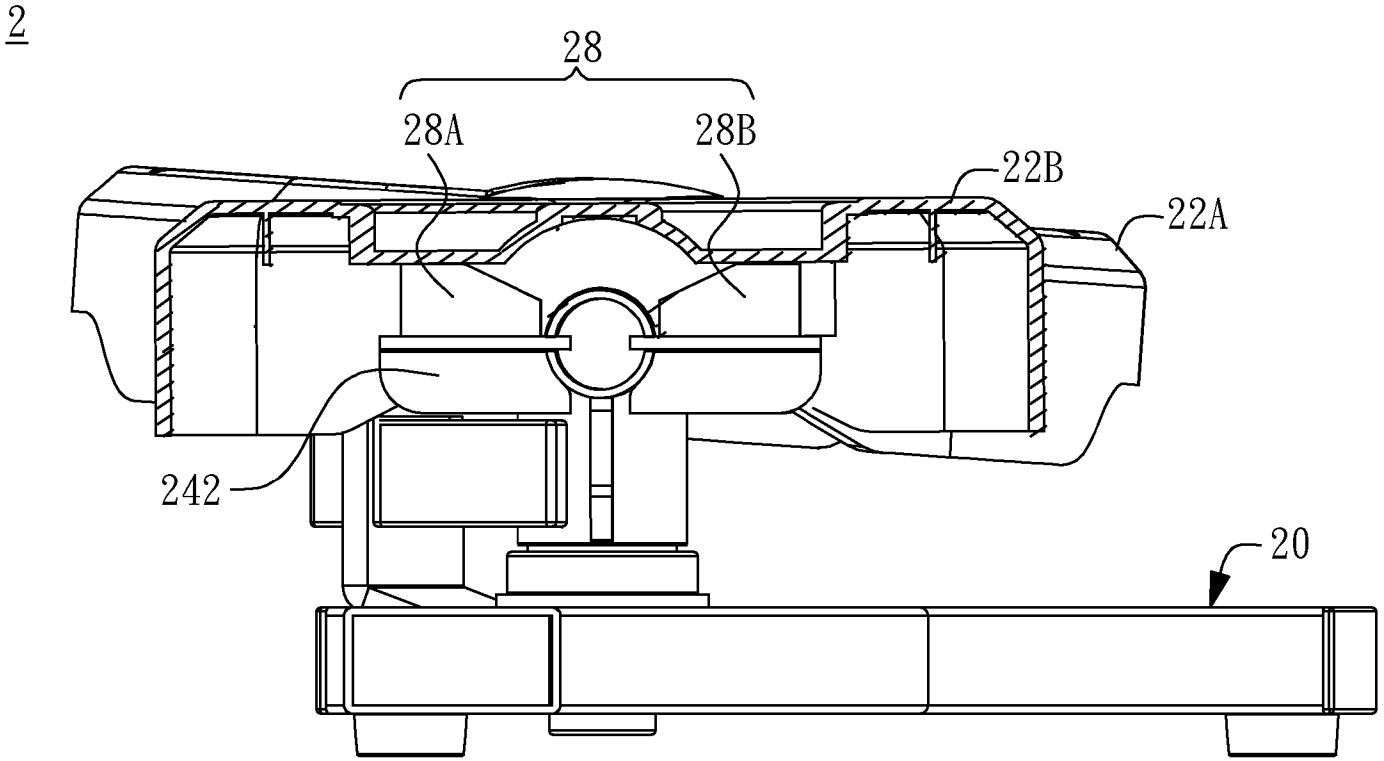
FIG. 4 is a side cross-sectional view of the figure trimmer according to the preferred embodiment of the present invention.

FIG. 4 is a side cross-sectional view of the figure trimmer 2 according to the preferred embodiment of the present invention. Referring to FIGS. 2-4, the pedal set 22 may comprise a left pedal 22A and a right pedal 22B, and the rotating assembly 24 may comprise a cylinder 240 and two supporting frames 242. The cylinder 240 is mounted on an axle 202 of the chassis 20, the two supporting frames 242 are respectively arranged at a side of the cylinder 240, and the two supporting frames 242 respectively couples to the left pedal 22A and the right pedal 22B. The left pedal 22A and the right pedal 22 can rotate about the coupled supporting frames 242 in a vertical direction.

As shown in FIGS. 3 and 4, two second elastic components 28 are respectively arranged between the left pedal 22A and its coupled supporting frame 242 and between the right pedal 22B and its coupled supporting frame 242. The two elastic components 28 are complementary to the supporting frame 242 and may fix with the supporting frame 242 by physical fitting or insertion.

As shown in FIG. 4, each second elastic component 28 may comprise a first portion 28A and a second portion 28B.

Figure 5:
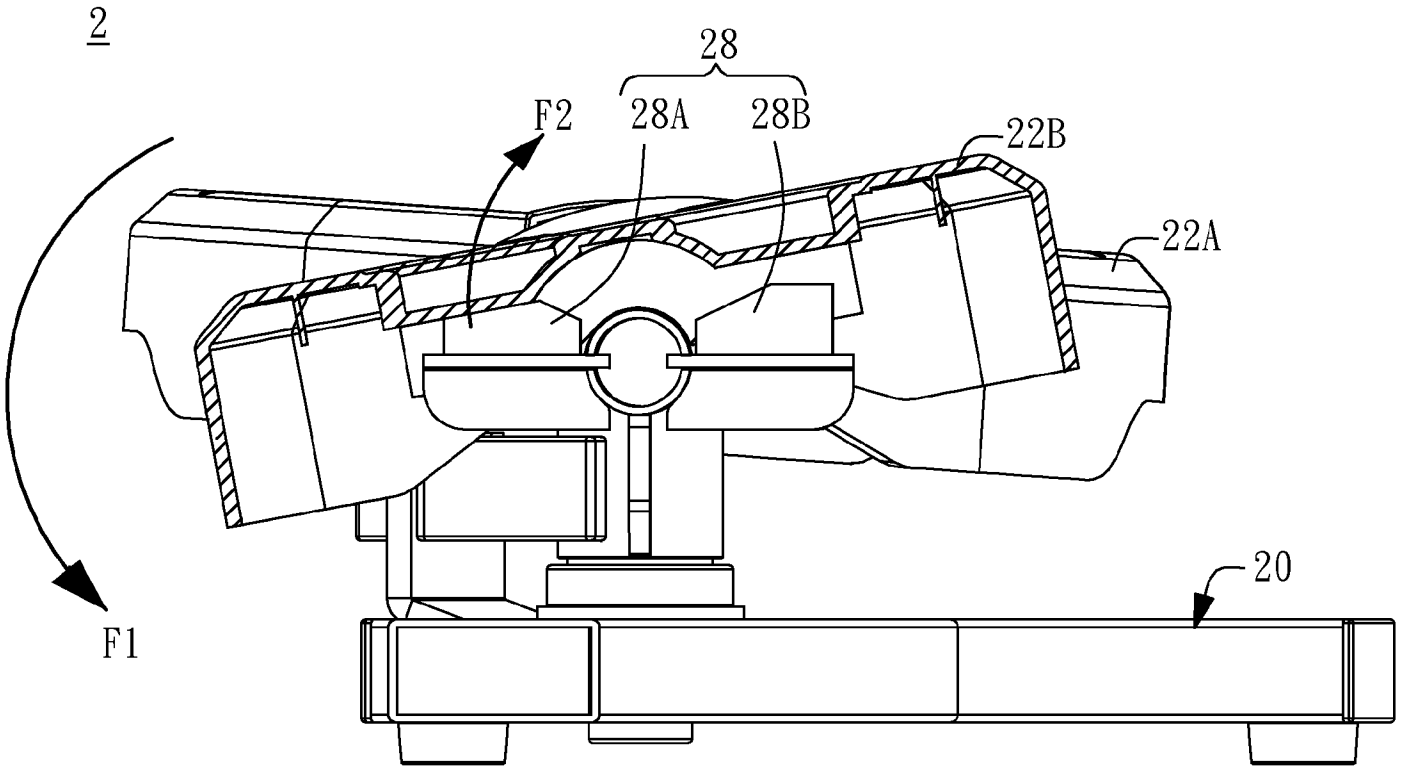
FIG. 5 is a side cross-sectional view showing the figure trimmer of the preferred embodiment of the present invention.

FIG. 5 is a side cross-sectional view showing the figure trimmer 2 of the preferred embodiment of the present invention. Taking the left pedal 22A as an example, when the user's left leg exerts a force F1 to the left pedal 22A and cause it to rotate counterclockwise, the first portion 28A of the second elastic component 28 exerts an opposite reaction force F2 to the left pedal 22A and cause it rotate clockwise.

Figure 6:
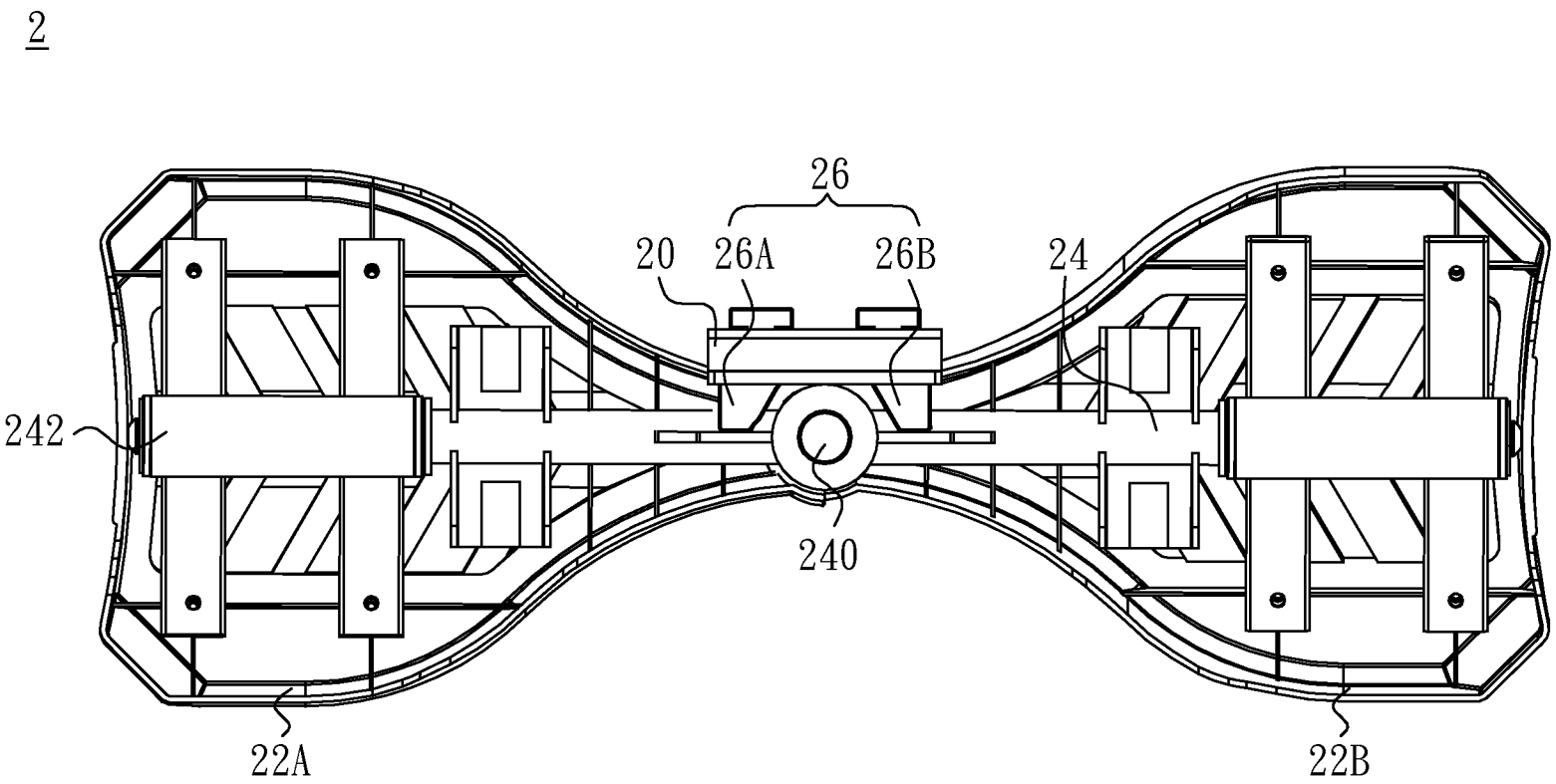
FIG. 6 is a top cross-sectional view showing the figure trimmer of the preferred embodiment of the present invention.

FIG. 6 is a top cross-sectional view showing the figure trimmer 2 of the preferred embodiment of the present invention. The first elastic component 26 may be arranged between the rotating assembly 24 and the chassis 26. Further, the first elastic component 26 may comprise a first portion 26A and a second portion 26B. The first elastic component 26 couples with the chassis 26. For example, the first elastic component 26 may fix with the chassis 26 by fitting or insertion.

Figure 7:
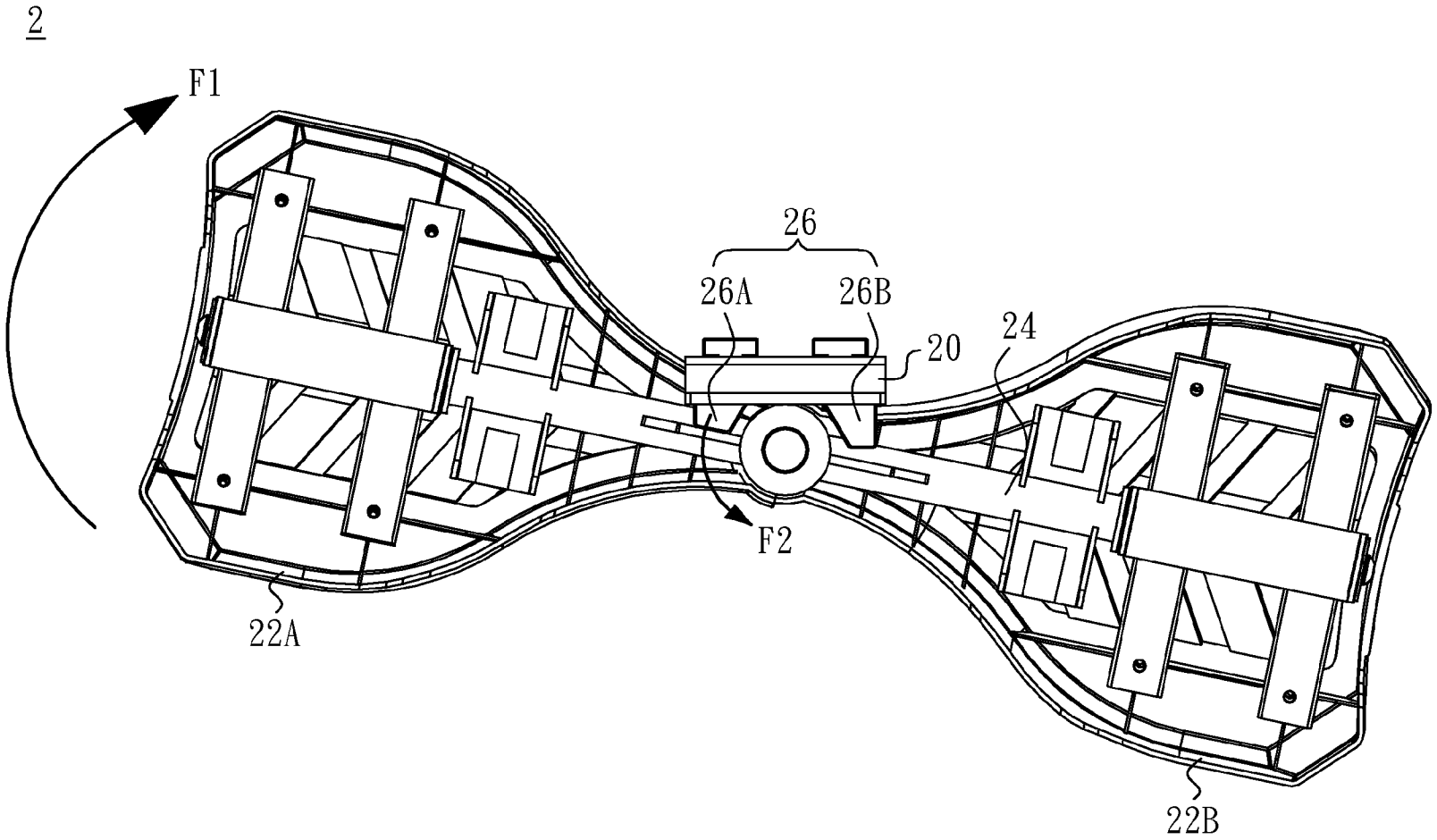
FIG. 7 is a top cross-sectional view showing the figure trimmer of the preferred embodiment of the present invention.

FIG. 7 is a top cross-sectional view showing the figure trimmer 2 of the preferred embodiment of the present invention. Taking the left pedal 22A (or the right pedal 22B as in another embodiment) as an example, when the user's left leg exerts a force F1 to the left pedal 22A and cause it to rotate clockwise, the first portion 26A of the first elastic component 26 exerts an opposite reaction force F2 to the left pedal 22A and cause it rotate counterclockwise.

In this embodiment, the number of the first elastic component 26 is single, whereas it can be plural, e.g., two in another embodiment of this invention. In this case, the two first elastic components can be symmetrically arranged around the cylinder 240.

In this preferred embodiment, because the figure trimmer has both the first elastic component 26 and the second elastic component 28, the left and right pedal 22A/22B can rotate in a vertical direction and rotate in a horizontal direction simultaneously.

In this preferred embodiment, the first elastic component 26 and the second elastic component 28 are made of a polymer.

In one embodiment, the first elastic component 26 and/or the second elastic component 28 is a spring member.

In one embodiment, the first elastic component 26 and/or the second elastic component 28 is a hydraulic elastic member.

In one embodiment, the first elastic component 26 and/or the second elastic component 28 is a pneumatic elastic member.

Accordingly, the present invention provides figure trimmer capable of rotating in both vertical and horizontal directions. Many muscles of the user, at least including muscles of thigh, shank, waist, and ankle will be trained by this mechanism, and hence the training efficiency can be promoted.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A figure trimmer, comprising:

a chassis;

a pedal set arranged on the chassis and provided for standing by a user, capable of making a reciprocated deflection in a vertical direction due to a vertical force exerted by the user;

a rotating assembly coupled to the chassis and the pedal set, driving the pedal set to make a reciprocated limited rotation around the rotating assembly in a horizontal direction due to a horizontal force exerted by the user;

at least a first elastic component, when the pedal set rotates in the horizontal direction, the first elastic component exerts a first opposite reaction force to the pedal set; and at least a second elastic component, when the pedal set deflects in the vertical direction, the second elastic component exerts a second opposite reaction force to the pedal set.

2. The figure trimmer as set forth in claim 1, wherein the pedal set comprises a left pedal and a right pedal, and the number of the at least one second elastic component is two with one arranged between the left pedal and the rotating assembly and another arranged between the right pedal and the rotating assembly.

3. The figure trimmer as set forth in claim 2, wherein the rotating assembly comprises a cylinder and two supporting frames, the cylinder is arranged on an axle of the chassis, and the two supporting frames are respectively arranged at a side of the cylinder and respectively coupled to the left pedal and the right pedal.

4. The figure trimmer as set forth in claim 3, wherein each of the two elastic components is complementary to the corresponding supporting frame and fixes with the corresponding supporting frame by fitting or insertion.

5. The figure trimmer as set forth in claim 3, wherein the first elastic component comprises a first portion and a second portion arranged around the axle of the chassis and arranged between the rotating assembly and the chassis.

6. The figure trimmer as set forth in claim 5, wherein the first elastic component couples to the chassis by fitting or insertion.

7. The figure trimmer as set forth in claim 1, wherein the first elastic component and the second elastic component are made of a polymer.

8. The figure trimmer as set forth in claim 1, wherein the first elastic component and the second elastic component are two spring members.

9. The figure trimmer as set forth in claim 1, wherein the first elastic component and the second elastic component are two hydraulic elastic members.

10. The figure trimmer as set forth in claim 1, wherein the first elastic component and the second elastic component are two pneumatic elastic members.

* * * * *